US011104477B2

(12) United States Patent
Kim

(10) Patent No.: US 11,104,477 B2
(45) Date of Patent: Aug. 31, 2021

(54) UNITARY PALLET

(71) Applicant: OZKOR Pty. Ltd., New South Wales (AU)

(72) Inventor: In Soong Kim, Younin-si (KR)

(73) Assignee: OZKOR PTY. LTD., New South Wales (AU)

( * ) Notice: Subject to any disclaimer, the term of this patent is extended or adjusted under 35 U.S.C. 154(b) by 0 days.

(21) Appl. No.: 16/533,980

(22) Filed: Aug. 7, 2019

(65) Prior Publication Data

US 2020/0047945 A1 Feb. 13, 2020

(30) Foreign Application Priority Data

Aug. 7, 2018 (AU) ..... 2018902874

(51) Int. Cl.
*B65D 19/00* (2006.01)

(52) U.S. Cl.
CPC ..... *B65D 19/0016* (2013.01); *B65D 2519/00034* (2013.01); *B65D 2519/00069* (2013.01); *B65D 2519/00139* (2013.01); *B65D 2519/00243* (2013.01); *B65D 2519/00268* (2013.01); *B65D 2519/00288* (2013.01); *B65D 2519/00303* (2013.01); *B65D 2519/00318* (2013.01); *B65D 2519/00467* (2013.01)

(58) Field of Classification Search
CPC ..... B65D 2519/00034; B65D 2519/00069; B65D 2519/00139; B65D 2519/00432; B65D 2519/00407; B65D 2519/00412
USPC .... 108/57.25, 57.26, 57.27, 57.28, 901, 902
See application file for complete search history.

(56) References Cited

U.S. PATENT DOCUMENTS 5,413,052 A * 5/1995 Breezer ..... B65D 19/0012 108/56.1
5,845,588 A * 12/1998 Gronnevik ..... B65D 19/0026 108/57.27
5,868,080 A * 2/1999 Wyler ..... B65D 19/0022 108/57.25
6,748,876 B2 * 6/2004 Preisler ..... B65D 19/0012 108/51.3
6,766,749 B2 * 7/2004 Lacabanne ..... B65D 19/0085 108/56.3
6,955,128 B2 * 10/2005 Apps ..... B65D 19/0012 108/57.25
7,640,867 B2 * 1/2010 Ogburn ..... B65D 19/0012 108/56.3
7,779,765 B2 * 8/2010 Donnell, Jr. ..... B65D 19/0016 108/57.26
7,918,166 B2 * 4/2011 Apps ..... B65D 19/0012 108/57.25
8,584,599 B2 * 11/2013 Sosa Bravo ..... B65D 19/0038 108/56.3
8,622,006 B2 * 1/2014 Dubois ..... B65D 19/0022 108/57.25
8,887,646 B2 * 11/2014 Skudutis ..... B65D 19/0012 108/56.3

(Continued)

*Primary Examiner* — Jose V Chen
(74) *Attorney, Agent, or Firm* — Coats & Bennett, PLLC

(57) ABSTRACT

A pallet having a top deck supported by four corner posts that extend to a bottom deck. The top deck has four side beams and four intermediate beams, with the beams each being provided with tubular reinforcements with the tubular reinforcements providing longitudinally extending passages that can receive reinforcing rods.

11 Claims, 9 Drawing Sheets

(56) References Cited

U.S. PATENT DOCUMENTS

| | | | | |
|---|---|---|---|---|
| 2006/0201401 | A1* | 9/2006 | Moore, Jr. | B65D 19/0095 108/57.25 |
| 2008/0210140 | A1* | 9/2008 | Valentinsson | B65D 19/0014 108/57.25 |
| 2011/0120353 | A1* | 5/2011 | Jensen | B65D 19/0016 108/57.25 |
| 2012/0304898 | A1* | 12/2012 | Dubois | B65D 19/0063 108/57.25 |
| 2012/0325125 | A1* | 12/2012 | Apps | B65D 19/0014 108/57.25 |
| 2014/0261103 | A1* | 9/2014 | Kelly | B65D 19/0006 108/57.28 |
| 2015/0025190 | A1* | 1/2015 | Grinsteinner | C08L 23/10 524/436 |
| 2018/0215505 | A1* | 8/2018 | Hawley | B65D 19/0095 |
| 2018/0305075 | A1* | 10/2018 | VanDort | F16B 12/24 |
| 2019/0135485 | A1* | 5/2019 | Apps | B65D 19/0038 |
| 2020/0087028 | A1* | 3/2020 | Hawley | B65D 19/0085 |
| 2020/0207512 | A1* | 7/2020 | Marconel Carpio | B65D 19/0093 |

* cited by examiner

UNITARY PALLET

RELATED APPLICATIONS

The present application claims priority to Australian Provisional Application No. 2018902874, filed Aug. 7, 2018, which is incorporated herein by reference in its entirety.

FIELD

The present invention relates to pallets moulded of plastics material, and more particularly, to plastics moulded from plastics material and having reinforcing members.

BACKGROUND

Plastic pallets include a body moulded of plastics material. To provide the body with sufficient rigidity, metal reinforcing members are traditionally attached to or embedded in the body.

A disadvantage of the above discussed pallets is that in order to recycle the materials, it is necessary to strip the plastics material from the metal reinforcing members. This process adds to the cost of recycling the plastics material from which the pallet bodies are formed. Additionally metal reinforcing members can be subject to rust and corrosion over time which has the disadvantage in respect of presenting a contamination risk. This is of particular concern in industries, such as the transport of food, where hygiene is a primary concern.

OBJECT

It is the object of the present invention to overcome or substantially ameliorate the above disadvantage.

SUMMARY OF INVENTION

There is disclosed herein a pallet including:

a body moulded of plastics material so as to provide a top deck and a bottom deck, the top deck providing a top surface upon which items to be transported are to rest, the bottom deck providing a bottom surface upon which the pallet is to rest by engaging a supporting surface, the body also providing side surfaces extending between the top and bottom surfaces;

at least one reinforcing member formed of plastics material and embedded in the top deck so as to be at least substantially enclosed thereby; and wherein said body has a density, and the reinforcing member has a density different to the density of said body.

Preferably, the density of the reinforcing member is greater than the density of the body.

Preferably, the reinforcing member extends longitudinally generally parallel to two of the edge surfaces, so as to have a longitudinal length extending substantially between the second edge surfaces.

Preferably, the body is moulded of polypropylene.

Preferably, the reinforcing member is formed of reinforced nylon.

Preferably, the reinforcing member is totally enclosed within said body.

There is disclosed herein a pallet of square or rectangular configuration and having a body moulded of plastics material so as to provide a top deck and a bottom deck, the top deck providing a top surface on which items to be transported are to rest, and a bottom deck providing a bottom surface upon which the pallet is to rest by engaging a supporting surface, four corner posts, each corner post extending between the top deck and the bottom deck, and wherein:

the top deck includes four edge beams, each edge beam extending between a respective two of the corner posts;

the body further includes four intermediate posts, each intermediate post being fixed to a respective one of the side beams, and being located generally centrally between the corner posts associated with the respective beam, a centre post extending between the top deck and the bottom deck, and four intermediate beams, each intermediate beam extending between a respective one of the intermediate posts and the centre post.

Preferably, each intermediate beam is provided with a plurality of tubular reinforcements.

Preferably, the body has four sides, each side being provided with a pair of passages that are configured to receive the tines of a forklift so that the tines may project internally of the body.

Preferably, each reinforcement provides a passage extending inwardly of the respective reinforcement from an end opening.

Preferably, the pallet further includes a reinforcing rod located in at least one of the passages.

BRIEF DESCRIPTION OF DRAWINGS

Preferred forms of the present invention will now be described by way of example with reference to the accompanying drawings wherein.

DESCRIPTION OF EMBODIMENTS

Figure 1:
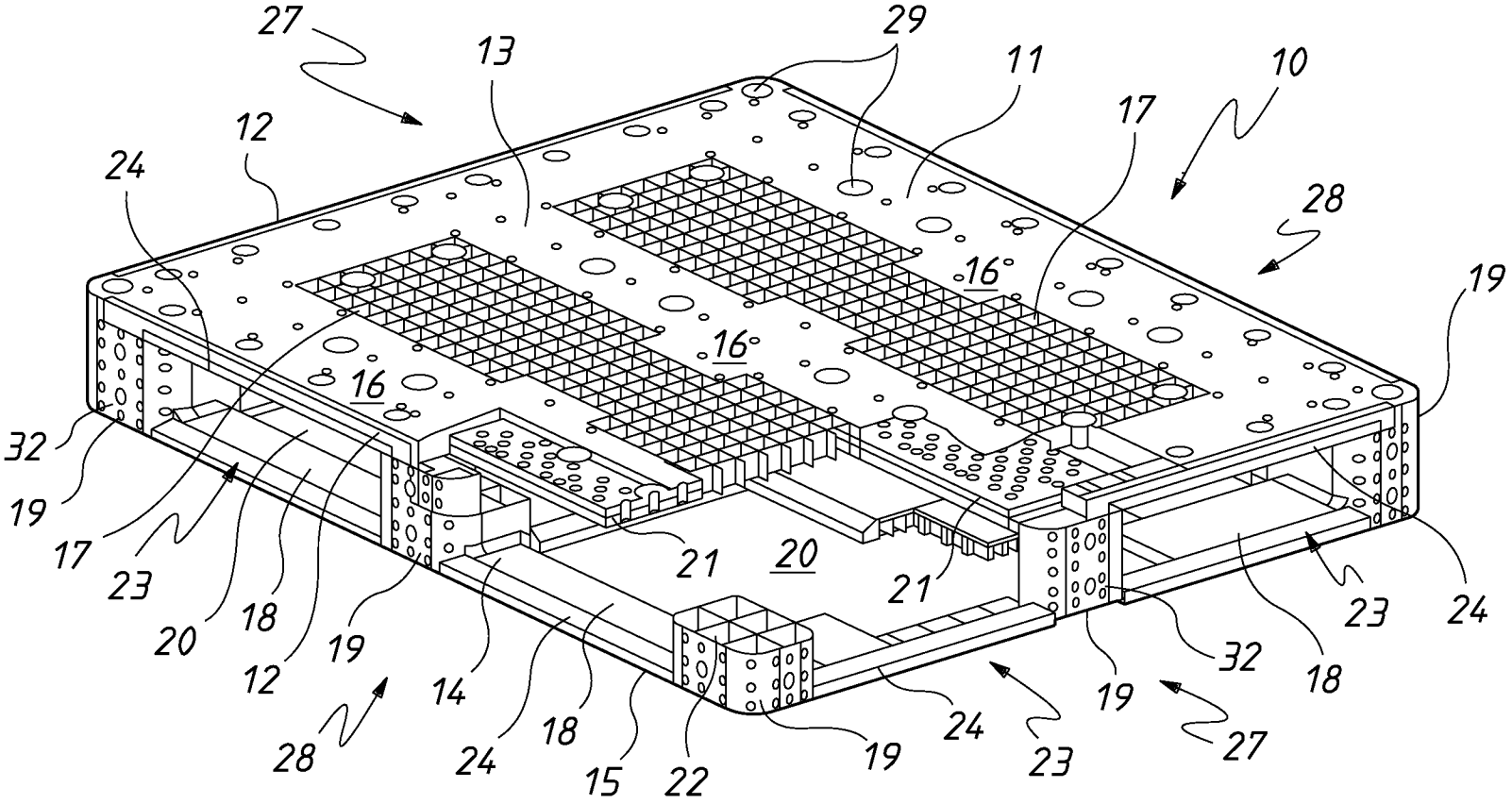
FIG. 1 is a schematic parts sectioned isometric view of a pallet.
Figure 2:
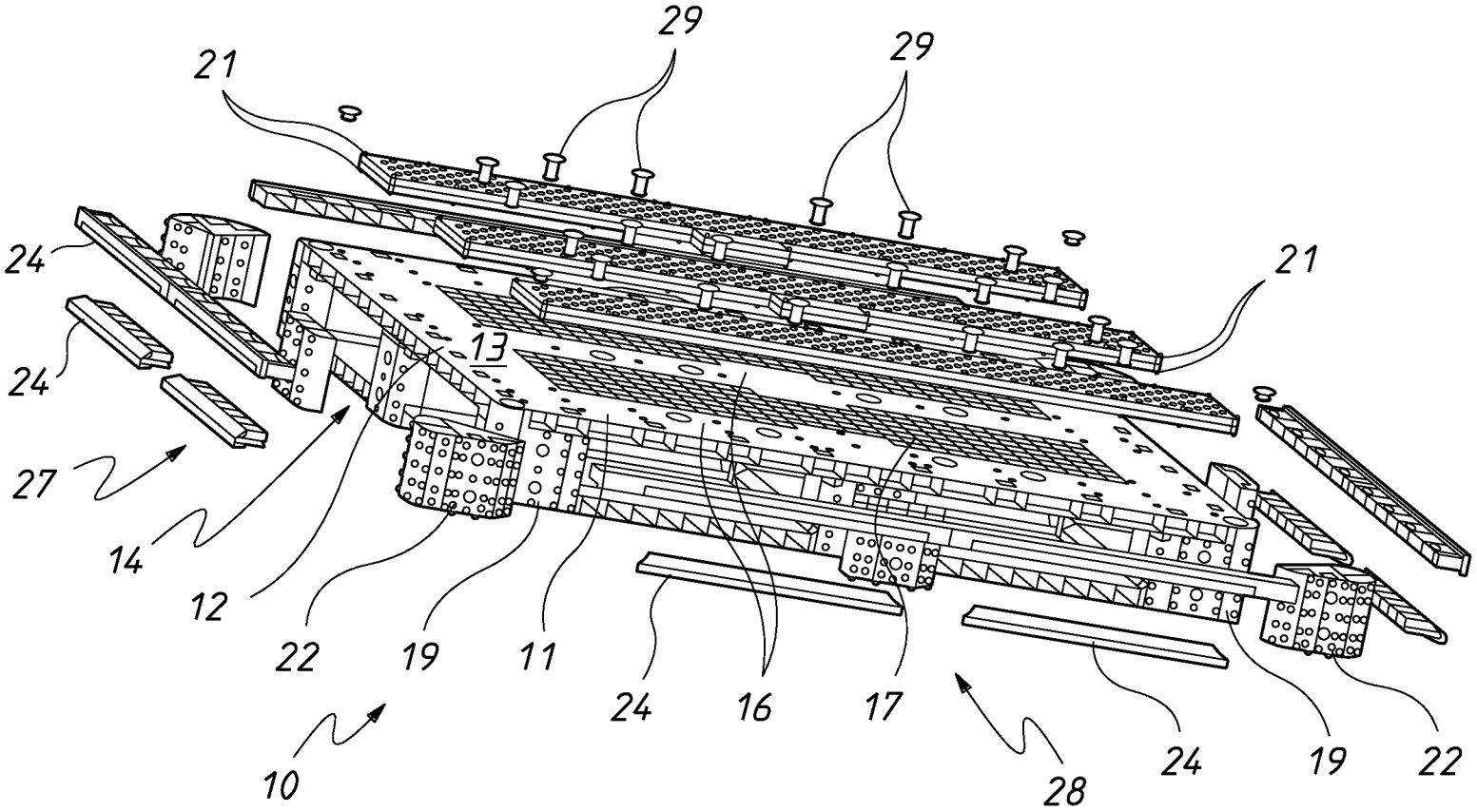
FIG. 2 is a schematic parts exploded isometric view of the pallet of FIG. 1.
Figure 3:
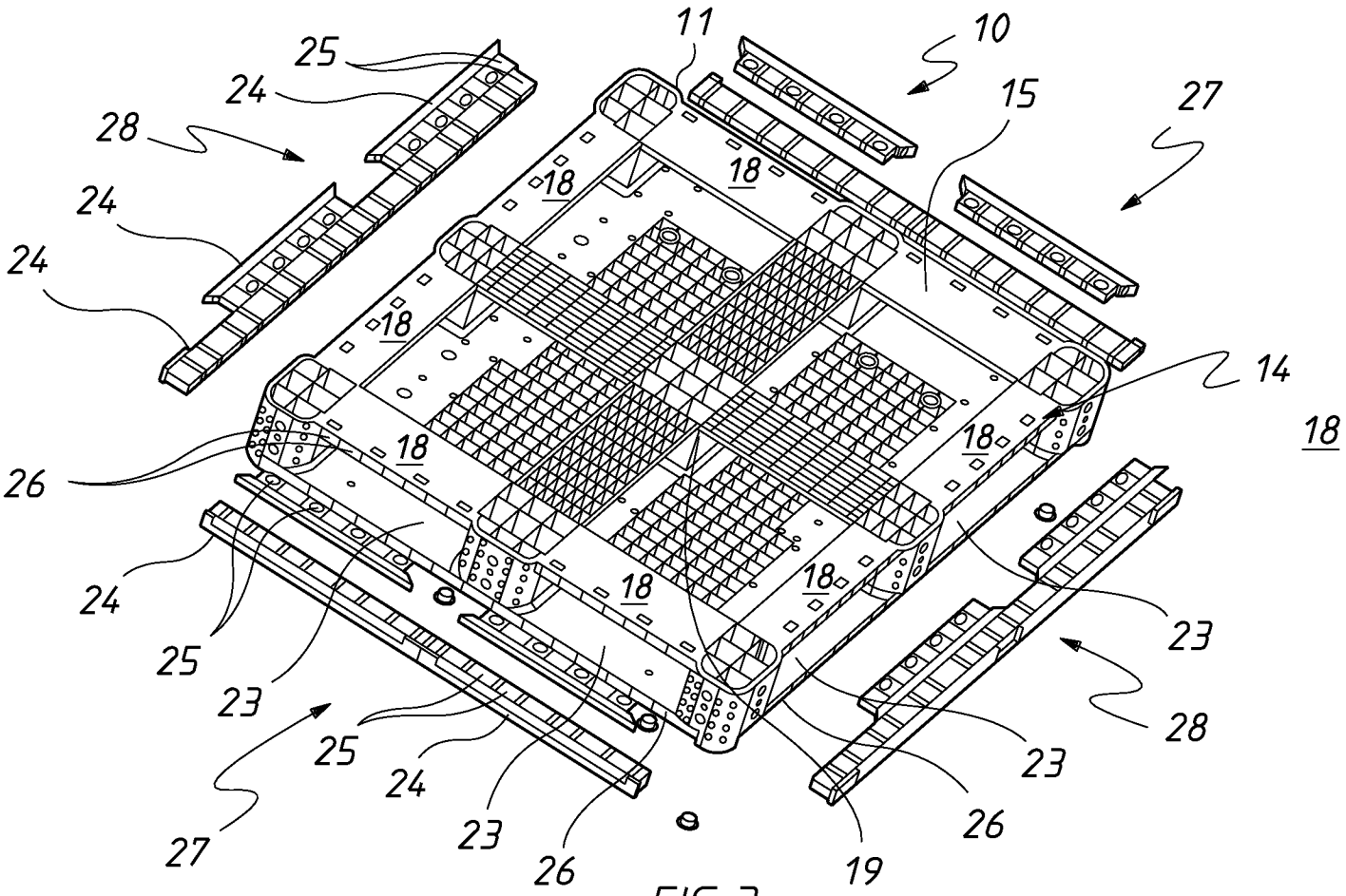
FIG. 3 is a schematic parts exploded isometric view of the pallet of FIG. 1.

In FIGS. 1 to 3 there is schematically depicted a pallet 10. The pallet 10 includes a body 11 moulded of plastics material, in particular the body 11 is moulded of polypropylene.

The body 11 is of a square or rectangular configuration and provides a top deck 12 providing a top surface 13 upon which items to be transported by the pallet are to rest.

The body 11 also provides a bottom deck 14, the bottom deck 14 providing a bottom surface 15 upon which the pallet 10 is to rest, with the surface 15 engaging a supporting surface.

Side surfaces 32 extend between the top surface 13 and bottom surface 15.

The top deck 12 includes solid portions 16 separated by mesh portions 17. The solid portions 16 have a thickness 28.

The bottom deck 14 is provided by a plurality of elongated portions 18, with the elongated portions 18 being connected to the solid portions 16 by a plurality of posts 19. Four of the posts 19 are located at corners of the pallet 10, while the remaining posts 19 are located intermediate the corner posts 19, while there also is a central post 19.

The bottom deck 14 provides voids 20 between the elongated members 19.

Embedded in the solid portions 16 are reinforcing members 21.

Preferably the body 11 is formed of a plastics material having a density, with the reinforcing members 21 formed of a plastic material having a density greater than the density of the body 11. As a particular example, the body 11 may be formed of polypropylene, and the reinforcing members 21 of reinforced nylon. The reinforced nylon would have a greater density than the polypropylene providing the body 11.

The reinforcing members 21 are moulded in the solid portions 16 when the body 11 is moulded.

Preferably, the members 21 are formed of reinforced nylon.

Preferably, the reinforcing members 21 are embedded in the solid portions 16, and are most preferably fully encased, but are at least substantially enclosed by the solid portions 16.

Located in the posts 19 are further reinforcing members 22 that are also formed of the abovementioned reinforced nylon. The reinforcing members 22 are moulded in the posts 19, when the body 11 is moulded.

Preferably, the reinforcing members 21 and 22 having apertures into which the plastic material forming the body 11 flows when the body 11 is being formed, to secure the members 21 and 22 to the body 11.

Preferably, the solid portions 16 have apertures that receive studs 29 that are fixed relative to the body 11, and provide resistance to movement of objects resting on the surface 1.

In the above described preferred embodiment, the pallet 10 has tine receiving passages 23, that receive the tines of a forklift. In this embodiment, the tines may be inserted into the tine passages 23 through any of the four sides of the pallet 10.

To at least aid in protecting the body 11 from impact with the forklift tines, there is provided replaceable impact strips 24, above and below the entrance to each of the passages 23. The strips 24 snap engage in recesses in the edge portions of the top deck 12, and edge portions of the elongated members 18.

In particular, the strips 24 each have a plurality of projections 25 that are received in correspondingly passages 26 of the body 11 so that the strips 24 are secured thereto.

In the above described preferred embodiment, the pallet 10 is of a rectangular configuration so as to have a first pair of sides 27, that are generally parallel co-extensive and transversely spaced, that extend between sides 28. The sides 28 are also generally parallel, transversely spaced and co-extensive, and generally perpendicular to the sides 27.

The reinforcing members 21 are generally longitudinally elongated, and extend generally parallel to the sides 28.

Preferably, the reinforcing members 21 are flat plates, and may each consist of a stack of two or more reinforcing members 21.

Figure 4:
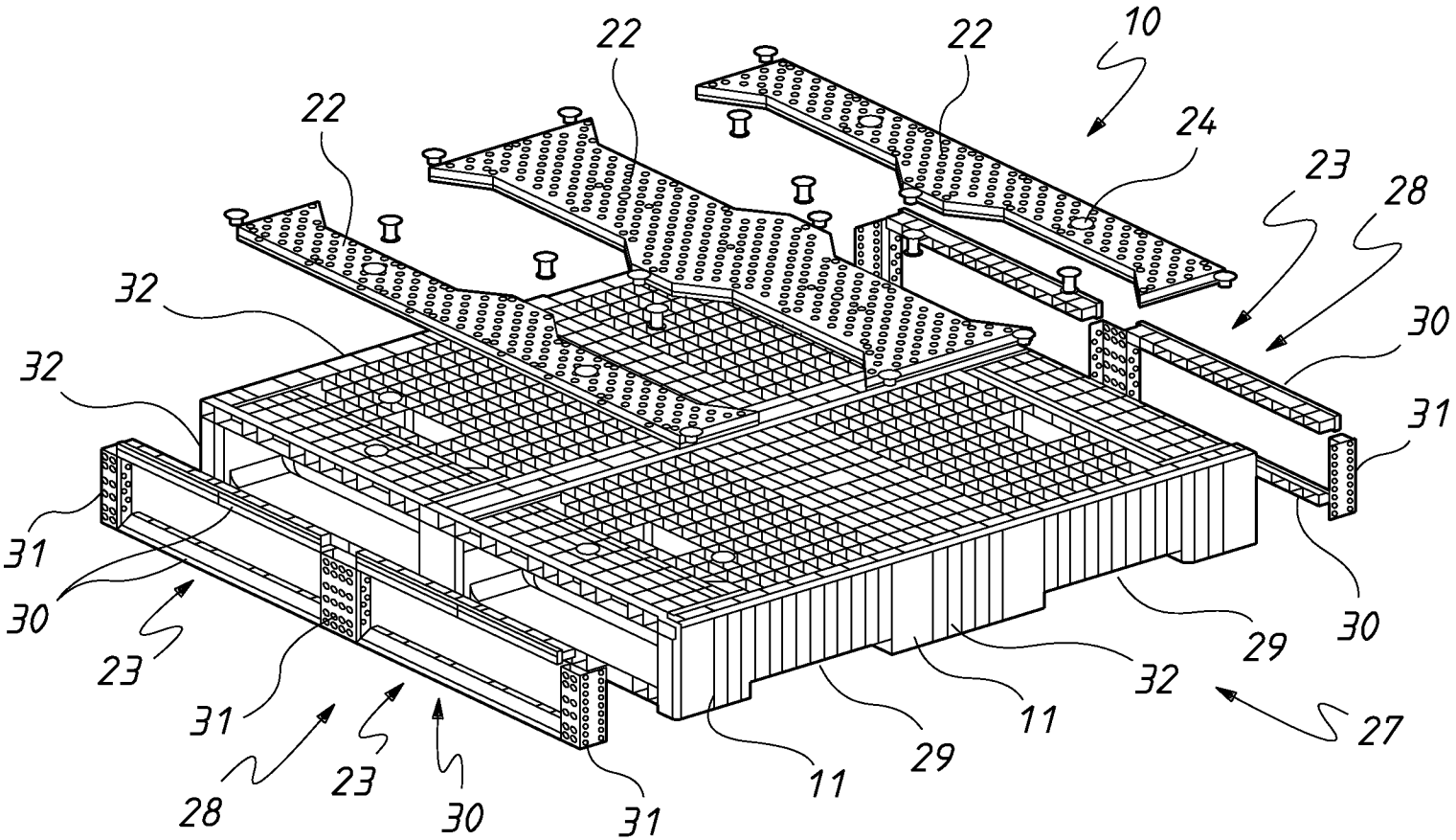
FIG. 4 is a schematic parts exploded isometric view of a modification of the pallet of FIG. 1.
Figures 5, 6:
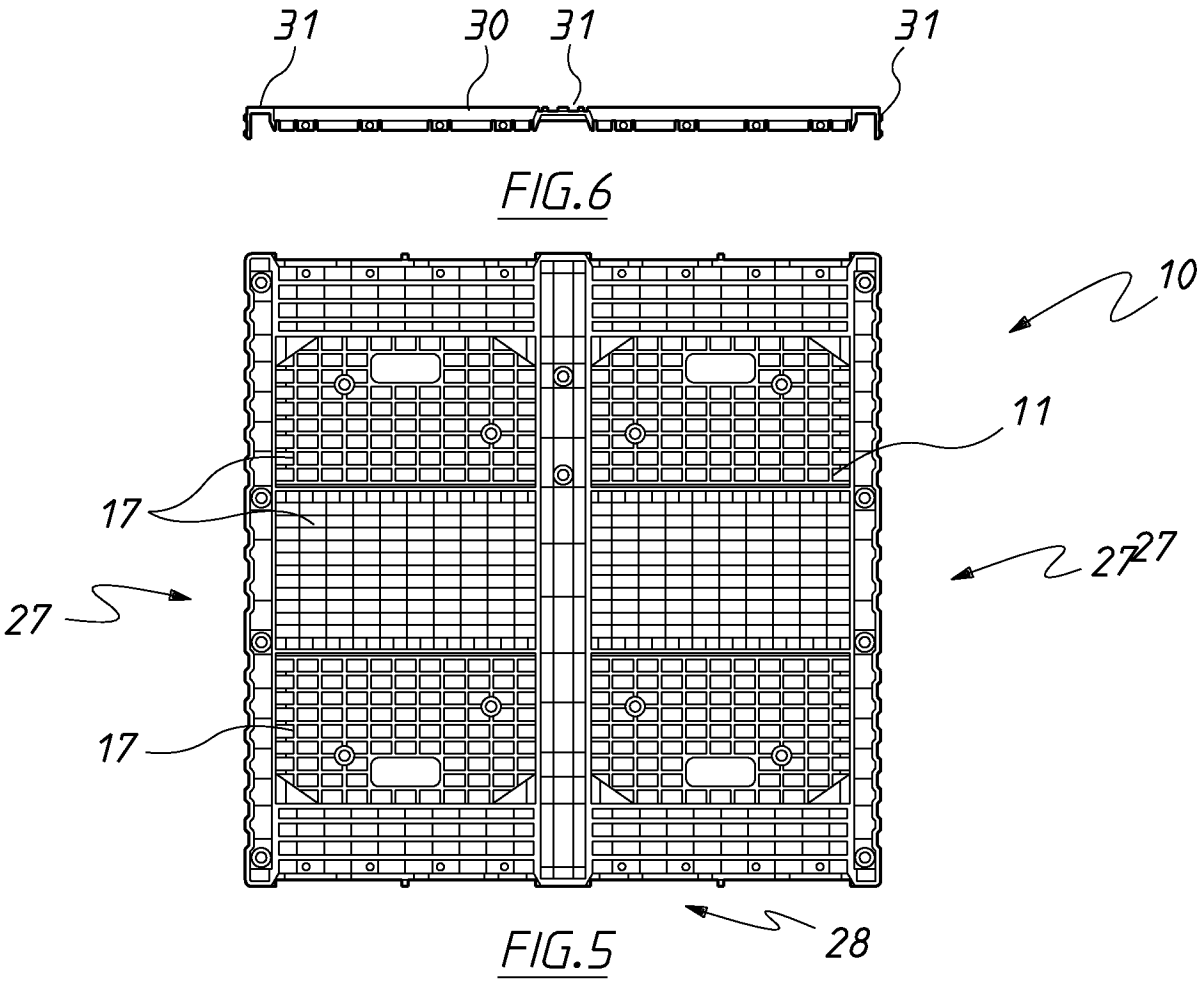
FIG. 5 is a schematic bottom plan view of the pallet of FIG. 4.
FIG. 6 is a schematic elevation of an edge member of the pallet of FIG. 4.
Figure 7:
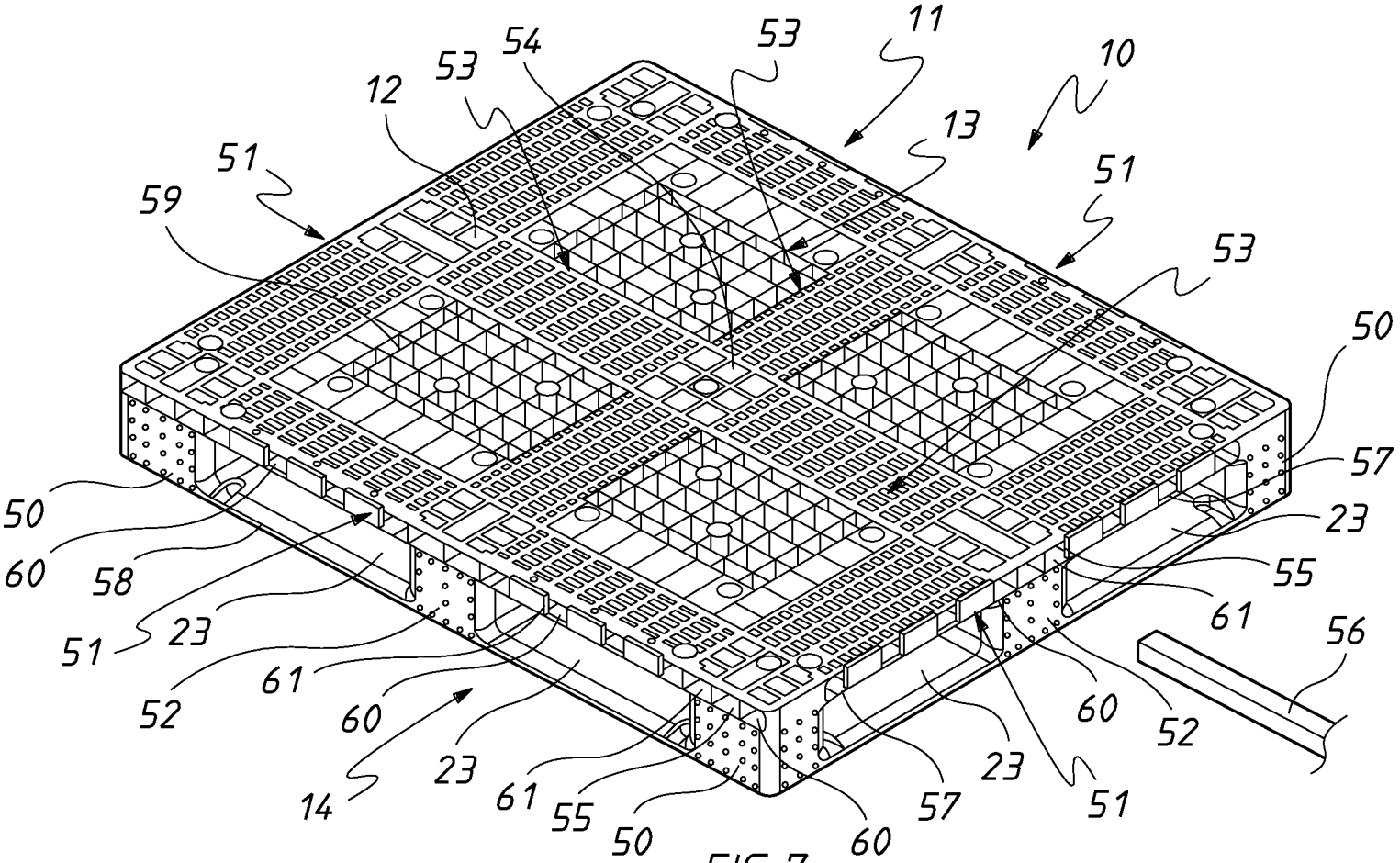
FIG. 7 is a schematic isometric view of a further pallet.
Figure 8:
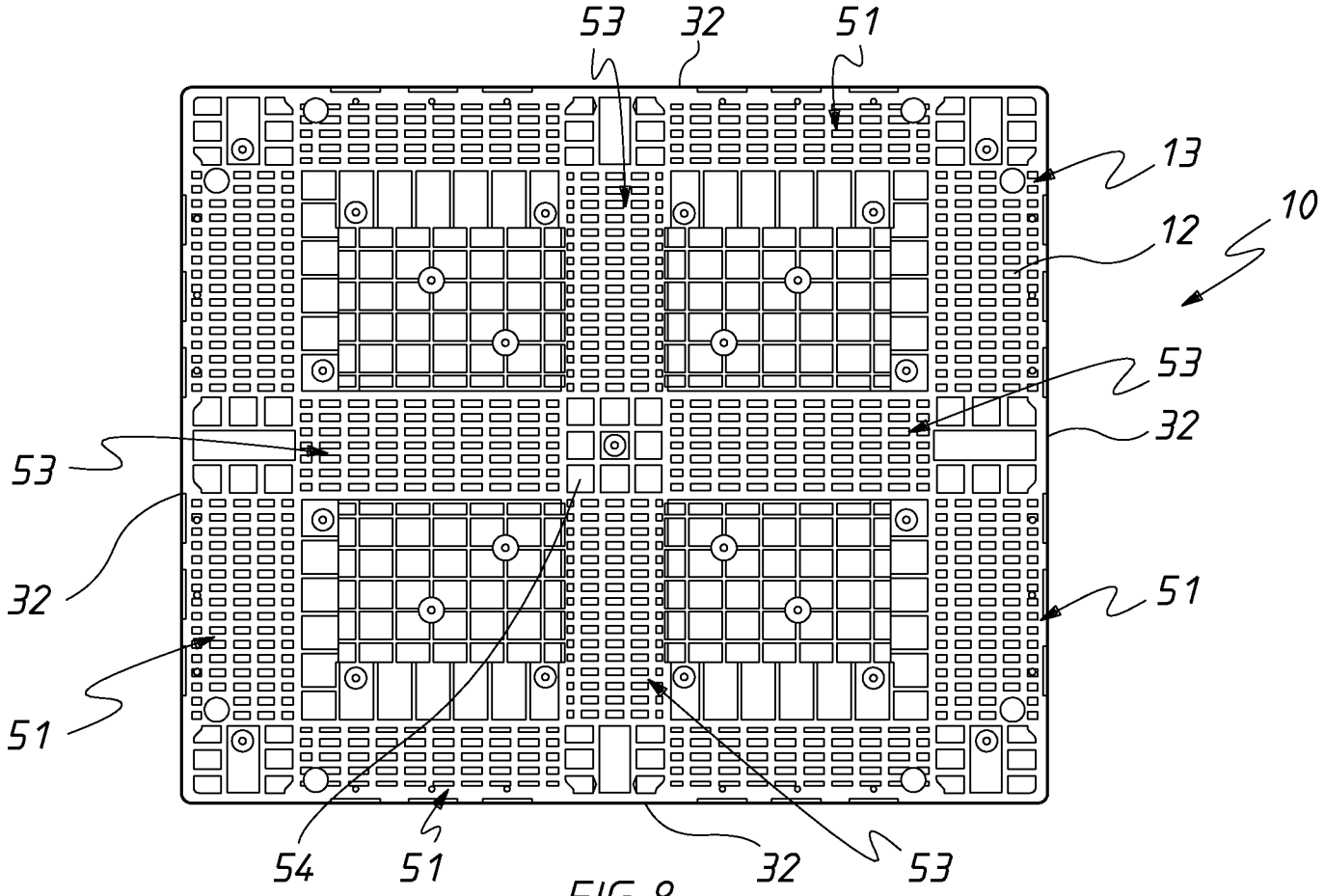
FIG. 8 is a schematic top plan view of the pallet of FIG. 7.
Figure 9:
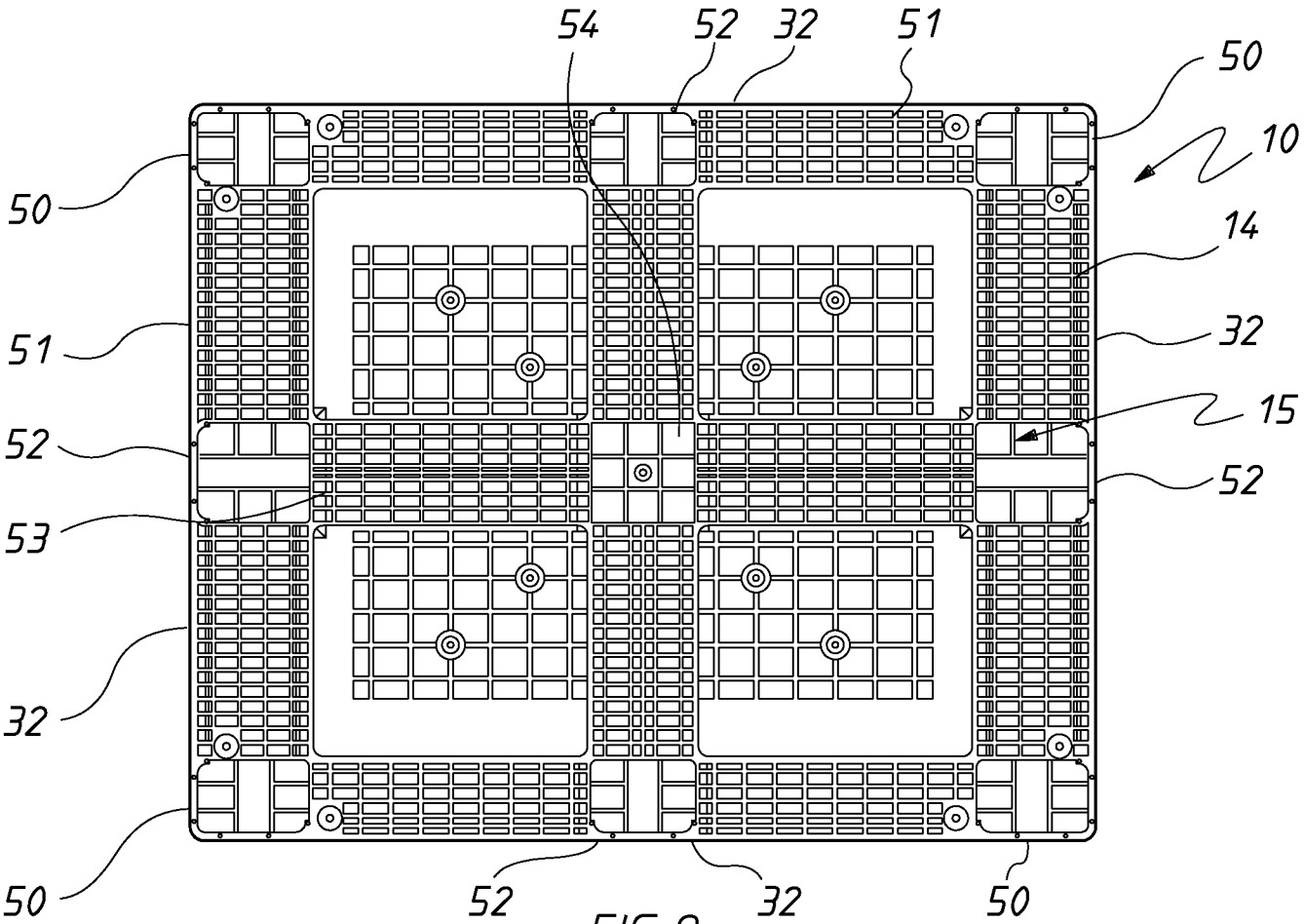
FIG. 9 is a schematic bottom plan view of the pallet of FIG. 7.
Figure 11:
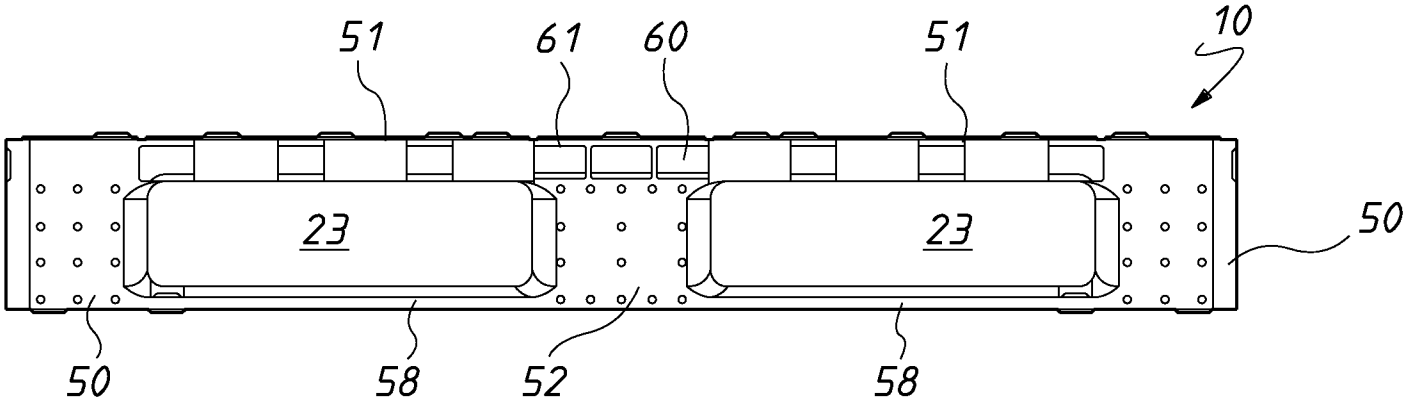
FIG. 11 is a schematic side elevation of the pallet of FIG. 7.
Figure 10:
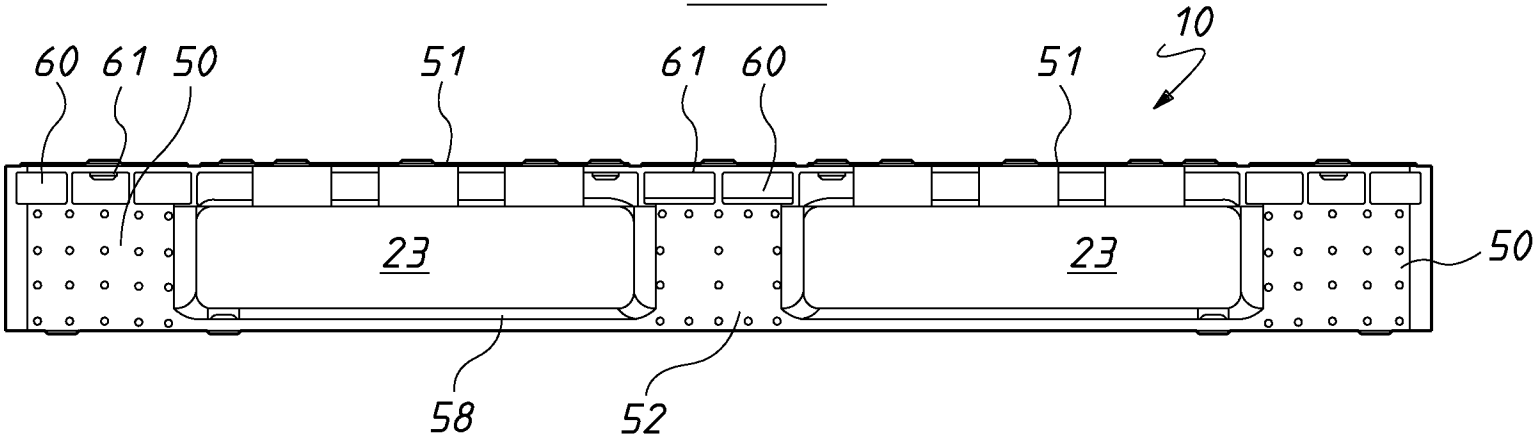
FIG. 10 is a schematic front elevation of the pallet of FIG. 7.

In the embodiment of FIGS. 4, 5 and 6, the body 11 is only provided with passages 23 extending between the sides 28. Accordingly, the forklift can only approach from two directions. In this embodiment, the sides 27 are provided with recesses 29 in the body 11 that are to engage a rack that is to receive the pallet 10.

In the embodiment of FIGS. 4, 5 and 6, the sides 28 are provided with impact strips 30, while the posts 19 are provided with reinforcing members 31. Additionally, the solid portions 16 of the previous embodiments have been replaced with further mesh portions 17, so as to provide more ventilation.

In the embodiment of FIG. 4, the reinforcing members 21 are also embedded in the body 11, but are illustrated as spaced from the body 11.

In this embodiment the pallet 10 is of a square configuration.

The above described preferred embodiments of FIGS. 1 to 6 have the advantage of aiding recycling of the plastics material forming the pallets 10. Recycling of the body 11 is assisted by grinding (granulating) the material forming the pallet 10, and then separating the body 11 material from the material forming the reinforcing members 21 and 22. This can be achieved as the material forming the body 11 has a different density relative to the material forming the reinforcing members 22. Preferably, the reinforcing material is of a greater density. In particular the reinforced nylon is denser than the polypropylene.

In the embodiment of FIGS. 7 to 11, the top deck 12 is supported by four corner posts 50 that extend between the top deck 12 and bottom deck 15. The top deck 12 includes four side beams 51 that extend between the corner posts 50 and are supported intermediate their length by intermediate posts 52. The top deck 12 further includes a pair of intermediate beams 53 that extend from each intermediate post 52 to a central post 54.

Each beam 53 includes longitudinally extending tubular reinforcings 55, that extend the full length of each beam 53 so as to extend from one of the posts 52 to the centre post 54. The tubular reinforcings 55 can be square, rectangular or circular in transverse cross-section, and can receive reinforcing rods 56 that may be formed of metal or plastics material. Each of the rods 56 extends from adjacent a respective one of the posts 52, to the centre post 54. To provide for insertion of the rods 56, each reinforcing 55 provides a passage 60 that extends inwardly from an end opening 61 at the side of the respective beam 51.

Each of the side beams 51 is provided with a plurality of transverse tubular reinforcings 57.

In respect of the bottom deck 14, the posts 50, 52 and 54 are joined by strips.

The area between the beams 51 and 53 have mesh portions 59.

As in the previous embodiment, the pallet can maybe square or rectangular in configuration and is moulded from plastics material, preferably high impact plastics material.

Additionally, the pallets 10 reduces the risk of contamination, particularly where food is being transported by the pallets 10.

What is claimed is:

1. A pallet including:

a body moulded of plastics material so as to provide a top deck and a bottom deck, the top deck providing a top surface upon which items to be transported are to rest, the bottom deck providing a bottom surface upon which the pallet is to rest by engaging a supporting surface, the body also providing side surfaces extending between the top and bottom surfaces, the top deck comprising solid portions that are separated by mesh portions;

stacked reinforcing members positioned in the solid portions and formed of plastics material and embedded in the top deck so as to be at least substantially enclosed thereby, the reinforcing members being a flat plates sized to extend within the solid portions and be spaced from the mesh portions;

wherein said body has a density, and the reinforcing member has a greater density than the density of said body.

2. The pallet of claim 1, wherein the reinforcing members extend longitudinally generally parallel to two of the edge surfaces, so as to have a longitudinal length extending substantially between the second edge surfaces.

3. The pallet of claim 1, wherein the body is moulded of polypropylene.

4. The pallet of claim 1, wherein the reinforcing members are formed of reinforced nylon.

5. The pallet of claim 1, wherein the reinforcing members are totally enclosed within the top deck of said body.

6. The pallet of claim 1, wherein the reinforcing member is moulded into the top deck.

7. A pallet including:

a top deck with a top surface, the top deck comprising solid portions separated by mesh portions;

reinforcing members embedded in the solid portions of the top deck, the reinforcing members comprising flat plates that are stacked in an overlapping arrangement;

a bottom deck with a bottom surface, the bottom deck comprising a plurality of elongated portions with intermediate voids;

a plurality of posts that extend between and connect to each of the top deck and the bottom deck, the top deck and the bottom deck constructed from a moulded plastic material with a first density, and the reinforcing members constructed from a second material with a second density that is greater than the first density.

8. The pallet of claim 7, wherein the top deck and the bottom deck are constructed from polypropylene and the reinforcing members are constructed from reinforced nylon.

9. The pallet of claim 7, wherein the reinforcing members are fully encased within the top deck.

10. The pallet of claim 7, wherein the posts comprise four corner posts and a central post and are constructed from reinforced nylon.

11. The pallet of claim 7, wherein the reinforcing members comprise apertures and the moulded plastic material of the top deck extends into the apertures.

* * * * *